US006565657B2

(12) United States Patent
Huthmacher

(10) Patent No.: US 6,565,657 B2
(45) Date of Patent: May 20, 2003

(54) HAND DEVICE FOR TRANSFERRING A FILM FROM A BACKING STRIP TO A SUBSTRATE, WITH A RETURN LOCK

(75) Inventor: Winfried Huthmacher, Frankfurt (DE)

(73) Assignee: BIC Deutschland GmbH & Co. (DE)

( * ) Notice: Subject to any disclaimer, the term of this patent is extended or adjusted under 35 U.S.C. 154(b) by 0 days.

(21) Appl. No.: 10/125,575

(22) Filed: Apr. 19, 2002

(65) Prior Publication Data

US 2002/0153106 A1 Oct. 24, 2002

Related U.S. Application Data

(63) Continuation of application No. PCT/EP00/10309, filed on Jun. 19, 2000.

(30) Foreign Application Priority Data

Oct. 22, 1999 (DE) ..... 299 18 667 U

(51) Int. Cl.[7] ..... B05C 17/10

(52) U.S. Cl. ..... 118/257; 118/76; 156/577; 156/579; 400/695; 400/696; 400/700; 242/421; 242/538.1; 242/538.3

(58) Field of Search ..... 118/76, 257; 156/577, 156/579; 400/695, 696, 700; 242/421, 538.1, 538.3

(56) References Cited

U.S. PATENT DOCUMENTS 5,851,348 A 12/1998 Muenzer et al. ..... 156/577

FOREIGN PATENT DOCUMENTS

| | | |
|---|---|---|
| DE | 42 20 712 A | 1/1994 |
| DE | 198 16 925 A | 10/1999 |
| EP | 0 606 477 A | 7/1994 |

*Primary Examiner*—Laura Edwards
(74) *Attorney, Agent, or Firm*—Pennie & Edmonds LLP

(57) ABSTRACT

A hand device for transferring a film, of, for example, adhesive, covering, or colored material, from a backing strip to a substrate. A supply spool and a take-up spool for the backing strip are rotatably mounted in a housing. An applicator tip is arranged on the housing and includes an application edge around which the backing strip runs. Furthermore, a brake mechanism, active during the functional operation of the hand device is provided. The brake mechanism has a locking device which interacts with one of the spools. To guarantee a compact design and economical fabrication, the locking device is arranged to be integral with the applicator tip.

17 Claims, 3 Drawing Sheets

HAND DEVICE FOR TRANSFERRING A FILM FROM A BACKING STRIP TO A SUBSTRATE, WITH A RETURN LOCK

CROSS REFERENCE To RELATED APPLICATIONS

The present application is a continuation of the U.S. National Stage designation of co-pending International Patent Application PCT/EP00/10309, filed on Oct. 19, 2000, which claims priority to German Patent Application 299 18 667.9, filed Oct. 22, 1999. The entire content of both these applications is expressly incorporated herein by reference thereto.

FIELD OF THE INVENTION

The present invention relates to an improved return lock device for a hand device for the transfer of a film from a backing strip to a substrate. More particularly, the present invention relates to a return lock that is integral with the applicator tip of the hand device.

BACKGROUND OF THE INVENTION

A hand device for transferring a film from a backing strip to a substrate (alternately referenced herein as a "hand device" for the sake of convenience without intent to limit), is described in DE 42 20 712 C2. In this hand device, a supply spool and a take-up spool are rotatably mounted in a housing. A backing strip is wound on the supply spool, extends from the supply spool to an applicator tip arranged on the circumference of the housing, is wound around an application edge of the applicator tip projecting outwardly from the housing, and extends as far as the take-up spool. To transfer a film from the backing strip to a substrate, the hand device is manually gripped, pressed with the applicator tip against the substrate, and at the same time moved along the substrate so that the film adheres to the substrate as the backing strip is pulled away from the supply spool, runs around the application edge of the applicator tip, and is wound on to the take-up spool. A drive connection is provided or is operative between the supply spool and the take-up spool. On application of the torque transmitted by pulling off the backing strip on to the storage spool, the drive connection drives the take-up spool so that it takes up the backing strip at a speed which is greater than the speed of removal. A sliding clutch is provided between the supply spool and the take-up spool to guarantee that the speeds of supply and take-up are the same, and that a certain tension in the backing strip running on the take-up spool is not exceeded. Thus, tearing of the backing strip is prevented because of the sliding clutch. Here, the supply spool and the take-up spool can be arranged on a common axis of rotation, i.e., adjacent to each other. Alternatively, the supply spool and the take-up spool can be arranged axially parallel in the same circumferential plane of the backing strip, the take-up spool being arranged between the supply spool and the applicator tip.

In the hand device described in DE 42 20 712 C2, the drive connection between the supply spool and the take-up spool with integrated sliding clutch is formed by at least one pair of friction surfaces directly engaging each other, which surfaces are formed on opposing inner and outer sides of the disc-shaped spool walls. In order to guarantee rotary entrainment between the spools due to the friction acting on the frictional surfaces, a compressive stress is required for pressing the frictional surfaces against each other and prestressing them. In the hand device described in this publication, the compressive stress is generated in that at least one of the two frictional surfaces, preferably both surfaces, are formed on spool sections arranged flexibly transverse to the frictional surface concerned. The surfaces are prestressed against each other by a resilience, preferably by the spool walls themselves. The effectiveness of the rotary entrainment can be increased by engaging knobs or teeth with which the spool sections engage in each other. In this case, it is also possible that the spool sections may not be prestressed against each other, but that the rotary entrainment depends on at least one of the spool sections deviating laterally, elastically, and flexibly on mutual contact of the knobs or teeth, thereby generating a moment of resistance providing the basis of the rotary entrainment between the knobs or teeth.

A further problem with the mode of operation of existing hand devices is that both the supply spool and the take-up spool tend to run backwards somewhat after a rotary movement caused by removing the backing strip, such as a result of stresses on the backing strip. The reels reversing in this way can cause small loops which can impair the function of the hand device.

A hand device for transferring a film from a backing strip to a substrate may be provided with a return lock interacting with the take-up spool to prevent the backing strip from being pulled off the take-up spool and forming loops if the hand device is used incorrectly. In such design, the return lock is formed by a ratchet drive consisting of a toothed rim arranged on the circumferential edge of one of the winding spool walls. The rim interacts with a ratchet arm which extends sectionally to the tooth rim, and is resiliently loaded against the tooth rim so that if the direction of rotation coincides with the direction of the take-up spool, the ratchet arm runs over the tooth rim and blocks a return rotation of the take-up spool, and hence prevents looping of the backing strip in the opposite direction of rotation due to engagement in the tooth rim. The ratchet arm is connected by a plug pin connection to the lateral housing wall or the cover of the housing.

The hand device described in EP 0 606 477 A1 (corresponding to U.S. Pat. No. 5,430,904) exhibits a locking mechanism for locking the rotation of the supply spool when the hand unit is not in use. As in DE 42 20 712 C2, a backing strip extends from a supply spool, loops around an applicator tip, and extends as far as a take-up spool. The applicator tip is displaceably mounted between a retracted position of non-use and a released position of use. A ratchet arm extends from the inner end of the applicator tip to the periphery of the supply spool arranged behind the take-up spool, bypassing the take-up spool. Moreover, a stationary articulated section on the existing housing is arranged in such a position that when the applicator tip is displaced to its position of use the ratchet arm is laterally deflected to such an extent that it cannot interact with a tooth rim on the supply spool. When the applicator tip is moved to its position of non-use, the ratchet arm moves into its locking position interacting with the tooth rim on the supply spool. This known locking mechanism is capable of preventing looping of the backing strip in the non-operative position of the hand device. However, looping which occurs in the position of use, due to the intrinsic elasticity of the backing strip, for example, or due to movement of the hand device in the incorrect direction of movement, cannot be avoided with this hand device.

SUMMARY OF THE INVENTION

The present invention provides a simplified design of a hand device for transferring a film from a backing strip to a substrate with a return lock. Moreover, a hand device that is easy to install, is inexpensive to manufacture, and/or has as few components as possible, is to be provided. The locking device of the return lock or brake is formed by a component which extends integrally from the applicator tip, in the direction of an associated spool, and interacts with the applicator tip to execute a return lock. This design avoids the need for additional parts and allows simple manufacture, storage, and installation, thereby reducing production costs. The return lock or brake is able to interact with the supply spool or the take-up spool. This is possible because of the self-locking action of the drive connection between the spools.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Exemplary hand devices formed in accordance with the principles of the present invention are illustrated in FIG. 1 through FIG. 4, in which same reference numbers refer to the same or similar components or elements.

A first embodiment of a hand device for transferring a film from a backing strip to a substrate is first described in greater detail with reference to the two sectional representations in FIGS. 1 and 2. The hand device provided with an application strip is particularly suited for transferring films of adhesive, covering, or colored material; a contact roll is preferably used instead of the application strip for transferring an adhesive film.

Figure 1:
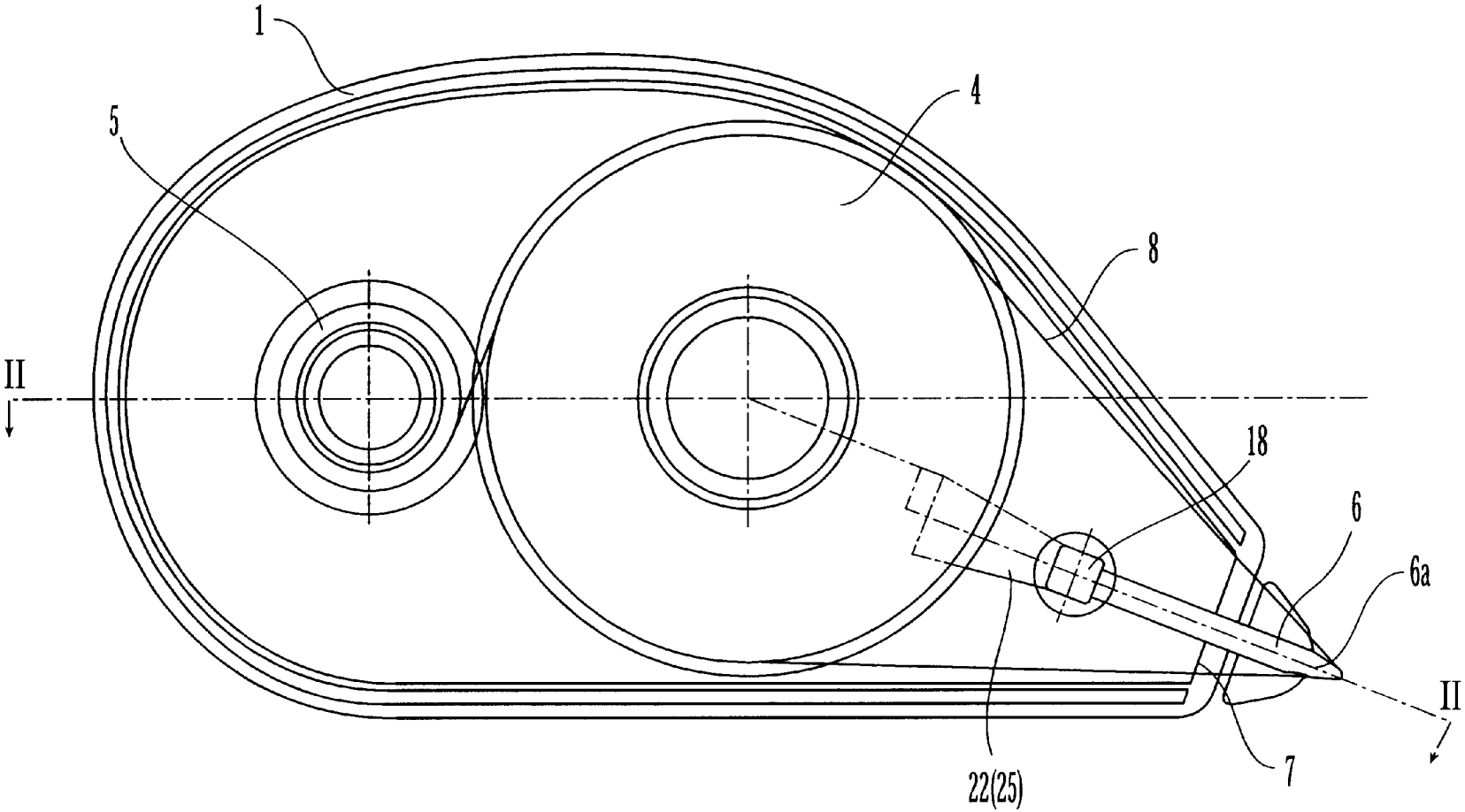
FIG. 1 is a side elevational view of a hand device, formed in accordance with the principles of the present invention, with the housing open along line I—I in FIG. 2.
Figure 2:
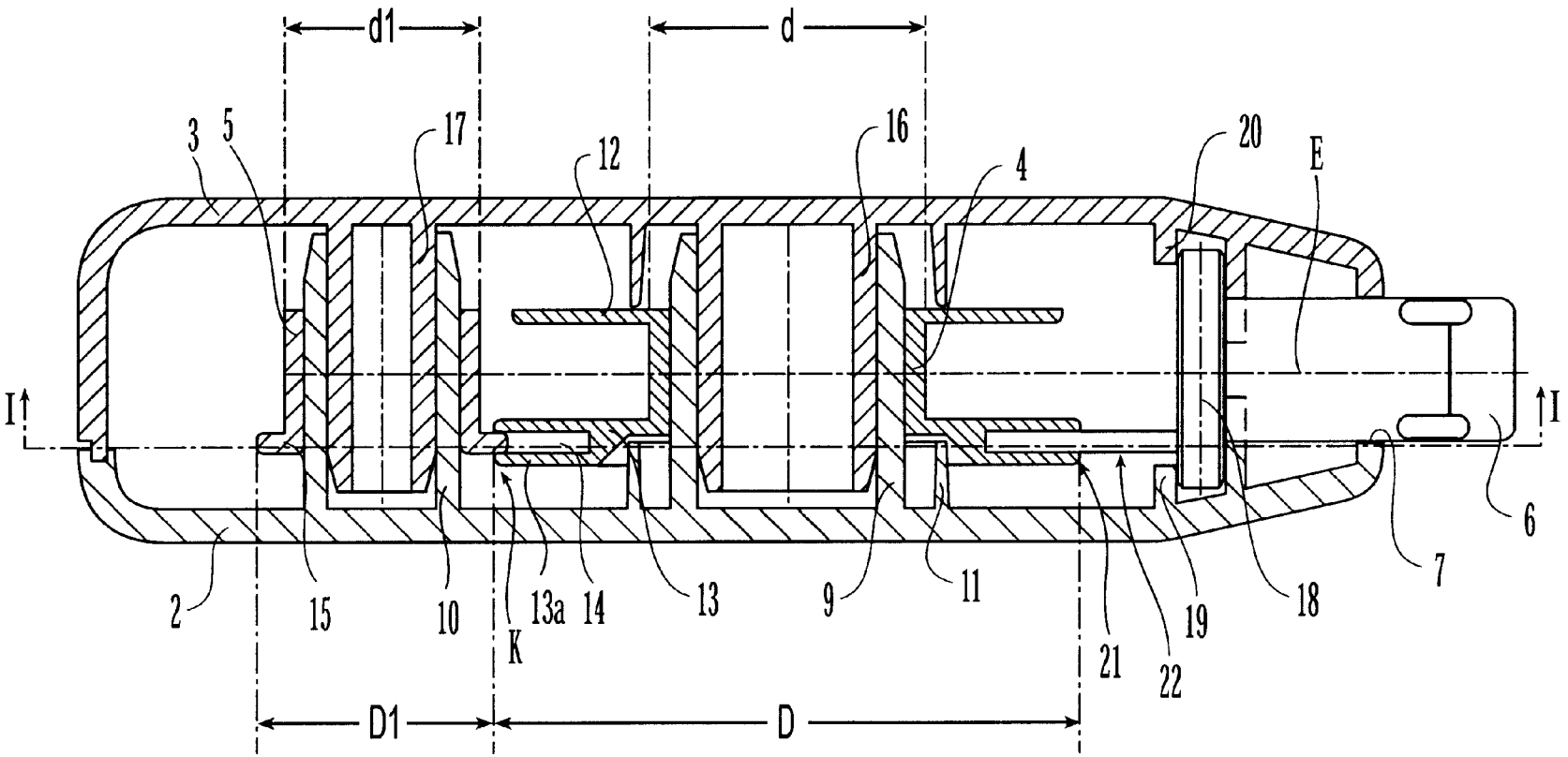
FIG. 2 is a top view of the hand device with the housing open along line II—II in FIG. 1.

The hand device shown in FIGS. 1 and 2 has a housing 1 including right and left housing sections 2, 3, viewed from above in the position of use, a supply spool 4 and a take-up spool 5 rotatably mounted in housing 1, and an applicator tip 6 with an application edge 6*a* which projects from housing 1 through an outlet port 7 in housing 1 in its front lower corner area (position of use). A backing strip 8, coated on one side with a film, is guided by supply spool 4 about applicator tip 6 to take-up spool 5.

All the parts of the hand device previously described and yet to be described may be formed of plastic and can be manufactured by injection molding, with the exception of backing strip 8.

As shown in FIG. 2, both spool bodies 4 and 5 are arranged so that they are radially offset from each other and are each rotatably mounted on a respective hollow shaft journal 9 and 10, formed on housing section 2. At least supply spool 4 is limited on both sides by a projection 11, which is arranged on the associated housing section 2, 3, and which runs concentrically to shaft journal 9, so that supply spool 4 is positioned in housing 1 so that backing strip 8 runs halfway up housing 1 and level with applicator tip 6 (yet to be described). Left housing section 3 exhibits two pins 16, 17 which are fitted into the recesses of shaft journals 9, 10 on right housing 2, and firmly seal housing 1 of the hand device.

Supply spool 4 is provided with a spool wall 12, 13, in the form of a radial disc, at both its axial ends, as shown in FIG. 2. Preferably, supply spool 4 and spool walls 12, 13 are formed as one piece. Right spool wall 13 is in this case thicker and has a slotted design, with an outer spool wall 13*a*. The depth of slot 14 may be approximately 5 mm and the width of slot 14 may be approximately 1 mm. The diameter of the left spool wall 12 is dimensioned slightly smaller than the diameter of the right spool wall 13, giving rise to an installation gap. Backing strip 8 is guided between the two spool walls 12, 13, where supply spool 4 can be wound as far as the larger outside diameter of the right spool wall 13.

A disc-shaped spool wall 15 is fitted on what is here the right end of take-up spool 5, as shown in FIG. 2. Preferably, supply spool 4 and spool walls 12, 13 are formed as one piece. The outside diameter of spool wall 15 is much smaller than the outside diameter of spool walls 12, 13 of the supply spool. The thickness of spool wall 15, the outside diameter of spool walls 13 and 15, and the mutual distance between the two spools 4 and 5 are dimensioned so that spool wall 15 is able to engage in slot 14 of spool wall 13. In this case the thickness of spool wall 14 of supply spool 4 and the radial engaging surfaces of spool wall 15 and/or the spool walls 13, 13*a* can be additionally roughened on one or both sides so that the two spool bodies 4 and 5 come into direct frictional contact with each other.

For the purpose of transferring the film arranged on the outside of backing strip 8 in the area of applicator tip 6 to a substrate, hand device 1 is gripped with one hand, placed on a substrate with an application edge 6*a* forming the front end of applicator tip 6, and moved under light pressure against the substrate in the direction of the arrow shown in FIG. 1. Backing strip 8 is thereby pulled off from supply spool 4 and wound onto take-up spool 5, and the film on backing strip 8 is detached from the portion of backing strip 8 on application edge 6*a* and remains on the substrate.

The active winding diameters d, d1 and engaging diameters D, D1 of spools 4, 5 (see FIG. 2) are matched so that the take-up speed of take-up spool 5 would be slightly greater than the unwinding speed of supply spool 4. This drive connection and rotary entrainment take place because of the frictional contact between the spools reinforced by knobs or teeth, or, if applicable, by a roughened surface, which contact is achieved in this embodiment by the clamping engagement of spool wall 15 between spool walls 13, 13*a*. This forms a sliding clutch K, which operates by frictional rotary entrainment, where the rotary entrainment can also be forced by knobs or teeth or by roughening of the frictional surfaces.

The thus designed frictional rotary entrainment between supply spool 4 and take-up spool 5 guarantees a drive and slip action, due to the corresponding torque transfer, which action causes take-up spool 5 to be driven at all times at the same speed and backing strip 8 to be lightly tensioned at all times, and also ensures that the backing strip 8 never tears. The design of drive connection 13, 14, 15 described above, with frictional drive, has the advantage that the elements in frictional contact with each other need not be prestressed. Because spool wall 15 is clamped in slot 14 of spool wall 13, a constant frictional force between spools 4, 5 is guaranteed at all times.

Because spool wall 15 engages in slot 14, winding spool 5 is also positioned on sleeve-shaped shaft journal 10 in the axial direction.

Applicator tip 6 exhibits at its end located in housing 1 a pin 18, which is preferably polygonal, for example square in cross-section. Pin 18 is received in corresponding recesses 19 and 20 on respective housing sections 2 and 3, so that it cannot rotate. The strip-shaped applicator tip 6 is preferably rigidly connected to pin 18. Application edge 6*a* itself can be formed from a soft, deformable plastic material. Alternatively, application edge 6*a* can also be rigidly designed and connected to pin 18 by an elastic intermediate piece.

Figure 3:
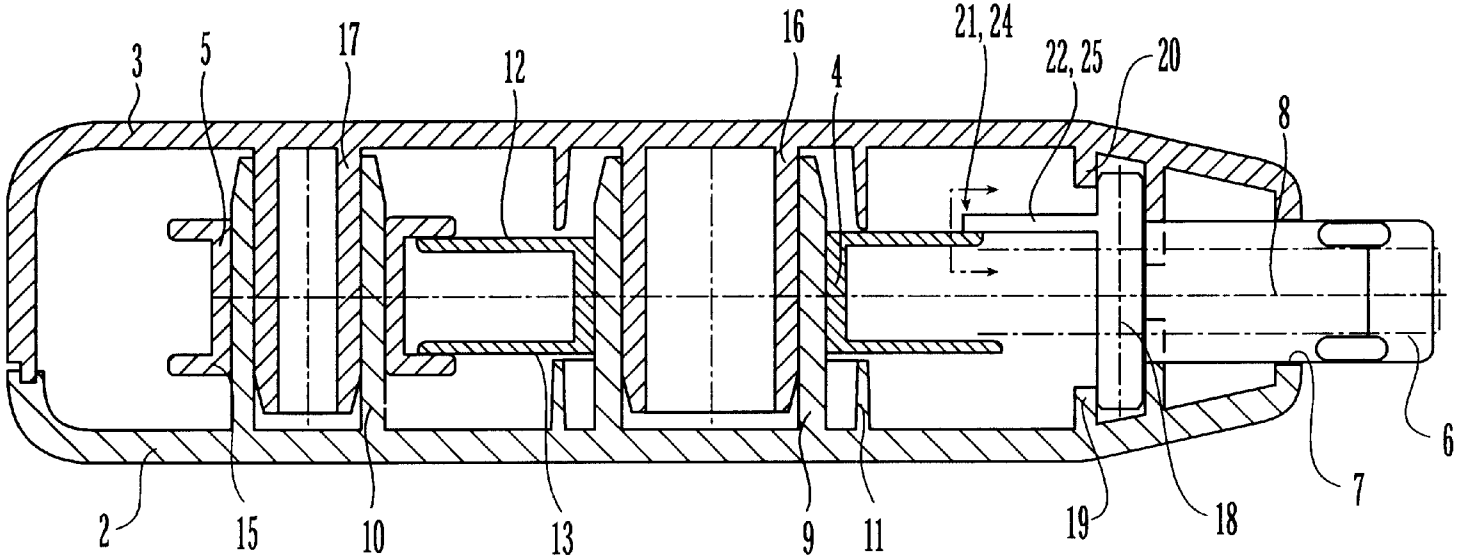
FIG. 3 is a top view of the hand device according to FIG. 2, in a modified design.
Figure 4:
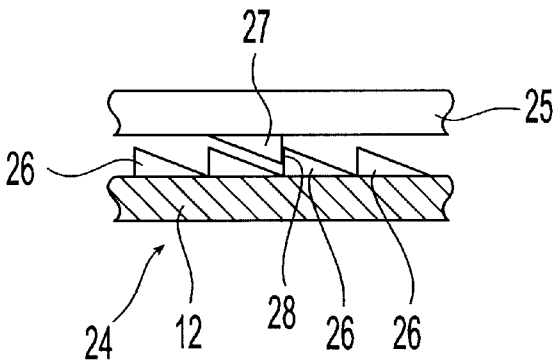
FIG. 4 is an enlarged view of the ratchet section according to FIG. 3, through a hand piece in a further modified design.

To prevent looping in backing strip 8, there is in housing 1 of the hand device a brake mechanism having a locking device that is associated with at least one of supply spool 4 and take-up spool 5 in order to prevent backwards rotation of the associated spool 4, 5. The brake mechanism may be in the form of a return brake 21 with a brake section 22 as shown in FIG. 3. Alternatively, the brake mechanism may be in the form of a ratchet drive 24 with a ratchet arm 25 as shown in FIG. 4.

Return brake 21 exhibits a brake section 22 which is formed in one piece on part of the hand device, e.g., on a housing section 2, 3, preferably at the inner end of applicator tip 6. In this embodiment, brake section 22 interacts with one of spools 4, 5 (in FIGS. 1 and 2, supply spool 4) when a braking function is performed, and is arranged adjacent to applicator tip 6. As is particularly evident from FIG. 2, brake section 22 is formed by an arm or better, for stability reasons, by a disc or a strip (preferably a flat strip) extending parallel to the plane of circumference E of backing strip 8. The disc or strip extends into slot 14 and, at least in this area, is dimensioned so thick that it engages with a limited clamping action between spool walls 13, 13*a*. The clamping action is determined by the thickness allowance and by the elastic tension with which spool walls 13, 13*a* clamp brake section 22 therebetween. When supply spool 4 rotates in functional operation, the braking action of return brake 21 is exaggerated, i.e., return brake 21 slides through.

In order to increase the braking action under the smallest possible lateral clamping stress, spool walls 13, 13*a* and brake section 22 can be roughened in the region of their frictionally engaging surfaces, in the area of at least one pair of surfaces, on one or both sides, or may be provided with knobs or teeth arranged one behind the other in the peripheral direction, which knobs or teeth engage in one another and then give rise to a greater rotary entrainment when they hit one another. Within the scope of the invention it is also possible to arrange knobs or teeth on one or both pairs of engaging surfaces between spool walls 13, 13*a,* and brake section 22, in which case spool walls 13, 13*a* do not clamp brake section 22 between them. Rotary entrainment is thus achieved when the knobs or teeth, which are arranged on the associated spool section on a particular sector thereof, hit one another as the associated spool rotates, spool walls 13, 13*a* deviating axially and elastically, and when the moment of rotary entrainment is generated.

As shown in FIG. 2, the hand device also is not limited by the fact that slot 14 is part of the rotary entrainment connection and also sliding clutch K between spools 4, 5. Within the scope of the invention, this rotary entrainment may also take place elsewhere, so that slot 14 is exclusively part of return brake 21.

In the embodiment shown in FIG. 3, where the same or comparable parts are provided with the same reference characters, the locking device of the brake mechanism is provided so that it does not engage between two spool walls. Instead, the locking device unilaterally comes into contact with an axial elastic tension on spool wall 12 or 13, preferably on the outside. The axial elastic tension is generated by prefabricating locking device, as far as spool wall 13 is concerned, with such an axial measure of displacement that it is slightly axially deflected in the assembly position, and rests on spool wall 13. The clamping action and resultant frictional action for rotary entrainment are generated as a result of this axial tension. No special adjustment of locking device in the axial direction is therefore required. The positive clamping is provided by the rigid support when the locking device is installed. The thinner section or both sections will deflect axially according to the thickness of spool wall 13 and the locking device, a condition of equilibrium being established in relation to the degree of deflection. This also applies to spool walls 13, 13*a* in the embodiment shown in FIG. 2. It will be appreciated that the brake mechanism may be in the form of a return brake 21 with a brake section 22, as described above, or in the form of a ratchet drive 24 with a ratchet arm 25, as described in further detail below in connection with FIG. 4.

As shown in FIG. 3, the rotary entrainment can also be forced by arranging knobs or teeth behind one another in the circumferential direction on the surfaces of engagement of spools 4, 5. Knobs or teeth hit one another when the corresponding spool 4, 5 rotates, and generate the rotary entrainment moment due to axial deflection of one or both parts and because of the resistance generated thereby.

In this embodiment, spool wall 13 and the locking device can also be provided on their engaging surfaces with teeth or knobs arranged behind one another in the peripheral direction. Spool wall 13 and the locking device thus do not clamp against each other axially, but rotary entrainment is produced when at least one knob or tooth on the locking device, and the knobs or teeth on spool wall 13, hit one another during the rotation of the spool, and when the locking device and/or spool wall 13 deviates axially and elastically.

As shown in FIG. 2, a drive connection or sliding clutch K is provided between spools 4, 5, in which spool walls 12, 13, 15 overlap each other in a fork shape, where the engaging surfaces concerned on one or both sides may be frictional surfaces, roughened frictional surfaces, or frictional surfaces provided with knobs or teeth, as already described in relation to the return brake shown in FIG. 3.

In the embodiment shown in FIG. 4, where the same or comparable parts are provided with the same references, a ratchet drive 24 is provided between the associated spool, here supply spool 4 or its spool wall 12, and a preferably disc-shaped ratchet arm 25, in contrast to the embodiments described above, where rotary entrainment elements may deviate axially. Ratchet drive 24, as a particular development of the brake mechanism, is formed by a tooth rim with ratchet teeth 26 on a sector of a circle on spool wall 12, and at least one tooth 27 engaging in tooth gaps on rachet arm 25. The teeth are saw-tooth-shaped so that the steep tooth flanks 28 hit each other in the direction of return rotation and therefore block a return movement of the associated spool. In the direction of rotation which is set in the correct functional operation, one or both parts deflect elastically.

In the embodiments described above, brake section 22 and ratchet arm 25 each extend inwardly from plug-in shaft 18 of application section 6.

Return brake 21 and ratchet drive 24 according to the invention may be manufactured simply, quickly, and at low cost, particularly if the associated parts consist of plastic and are manufactured by injection molding.

In the embodiments where knobs or teeth are provided for the rotary entrainment connection, a rattling or clicking noise is generated in the correct direction of rotation of the spool. Within the scope of the invention, return brake 21 or ratchet drive 24 may interact with supply spool 4 or take-up spool 5. During the interaction with supply spool 4, the rotary entrainment connection or sliding clutch K exerts a self-locking action on take-up spool 5 so that its backward rotation is largely avoided. An interaction of return brake 21 or ratchet drive 24 with take-up spool is even more effective.

What is claimed is:

1. A hand device for transferring a film from a backing strip to a substrate, said hand device comprising:

a housing;

a supply spool on which a backing strip carrying a film is supplied;

an applicator tip projecting from said housing and around which the backing strip runs;

a take-up spool on which the backing strip is wound after the film is transferred therefrom to a substrate; and a brake mechanism associated with one of said spools;

wherein said brake mechanism:

is active during functional operation of said hand device;

has a locking device which interacts with said one of said spools; and is integral with said applicator tip.

2. A hand device as in claim 1, wherein:

said at least one of said spools has a spool wall; and said locking device interacts with said spool wall.

3. A hand device as in claim 2, wherein said locking device frictionally engages said one of said spool walls.

4. A hand device as in claim 2, wherein said brake mechanism is a ratchet drive.

5. A hand device as in claim 2, wherein said locking device clamps into a slot arranged in said spool wall.

6. A hand device as in claim 1, wherein said locking device extends in a straight direction.

7. A hand device as in claim 6, wherein the backing strip extends in a peripheral plane and said locking device is parallel to the peripheral plane.

8. A hand device as in claim 1, wherein said locking device is in the form of a flat strip or disc.

9. A hand device as in claim 1, wherein said locking device and said one of said spools overlap laterally and are pretensioned against each other by an elastic resilience along an axis of rotation of said one of said spools.

10. A hand device as in claim 9, wherein said locking device and said one of said spools are pretensioned against each other by an intrinsic elasticity.

11. A hand device as in claim 9, wherein an engaging surface is defined on at least one of said locking devices and said one of said spools.

12. A hand device as in claim 11, wherein said engaging surface is rough.

13. A hand device as in claim 12, wherein said engaging surface is provided with a row of knobs or teeth.

14. A hand device as in claim 13, wherein said knobs or teeth are provided on said engaging surface in a row.

15. A hand device as in claim 1, wherein:

said locking device is a ratchet arm; and said ratchet arm and said one of said spools overlap laterally and flexibly.

16. A hand device as in claim 15 wherein said ratchet arm and said one of said spools have ratchet teeth that engage each other.

17. A hand device as in claim 16, wherein said ratchet teeth are arranged on a sector of said spool.

* * * * *

UNITED STATES PATENT AND TRADEMARK OFFICE

CERTIFICATE OF CORRECTION

PATENT NO. : 6,565,657 B2
DATED : May 20, 2003
INVENTOR(S) : Huthmacher

It is certified that error appears in the above-identified patent and that said Letters Patent is hereby corrected as shown below:

Title page,
Item [63], change "Continuation of application No. PCT/EP00/10309, filed on Jun. 19, 2000." to -- Continuation of application No. PCT/EP00/10309, filed on October 19, 2000. --

Signed and Sealed this

Fourteenth Day of October, 2003

JAMES E. ROGAN
*Director of the United States Patent and Trademark Office*